United States Patent [19]

Nolan

[11] 4,158,419

[45] Jun. 19, 1979

[54] IMPLOSION PROTECTED CRT

[75] Inventor: Richard A. Nolan, Lancaster, Pa.

[73] Assignee: RCA Corporation, New York, N.Y.

[21] Appl. No.: 864,763

[22] Filed: Dec. 27, 1977

[51] Int. Cl.[2] ..... H01J 61/35

[52] U.S. Cl. ..... 220/2.1 A; 427/106; 428/425; 358/245; 358/246

[58] Field of Search ..... 220/2.1 A; 358/245-247; 313/479; 215/DIG. 6, 1 C; 428/425; 427/106, 64

[56] References Cited

U.S. PATENT DOCUMENTS

| | | | |
|---|---|---|---|
| 2,293,529 | 8/1942 | Bedford | 358/247 |
| 3,071,280 | 1/1963 | Mayhew et al. | 220/2.1 A |
| 3,220,592 | 11/1965 | Powell et al. | 220/2.1 A |
| 3,220,593 | 11/1965 | Powell et al. | 220/2.1 A |
| 3,298,553 | 1/1967 | Lusher | 220/2.1 A X |
| 3,382,999 | 5/1968 | Powell et al. | 220/2.1 A |
| 3,383,000 | 5/1968 | Powell et al. | 220/2.1 A |
| 3,404,302 | 10/1968 | Nicklas | 220/2.1 A X |
| 3,412,203 | 11/1968 | D'Angelo | 220/2.1 A X |
| 3,416,026 | 12/1968 | Niwa | 315/31 |
| 3,471,317 | 10/1969 | Clock | 220/2.1 A X |
| 3,489,966 | 1/1970 | Bradu et al. | 313/283 X |
| 3,508,310 | 4/1970 | Eisses | 358/246 X |
| 3,557,306 | 1/1971 | Inglis | 358/246 |
| 3,823,032 | 7/1974 | Ukai | 215/DIG. 6 X |
| 3,837,829 | 9/1974 | Lebel et al. | 65/43 X |
| 3,864,152 | 2/1975 | Kitamura et al. | 215/DIG. 6 X |
| 3,889,031 | 6/1975 | Tatsumi et al. | 215/DIG. 6 X |
| 4,065,589 | 12/1977 | Lenard et al. | 428/430 X |

*Primary Examiner*—Allan N. Shoap

*Attorney, Agent, or Firm*—E. M. Whitacre; G. H. Bruestle; L. Greenspan

[57] ABSTRACT

In combination, a CRT (cathode-ray tube) comprising an envelope including a glass faceplate panel and an adjoining glass funnel sealed to said panel, an elastomeric film coating consisting essentially of polyurethane around and adhered to said panel and a continuous metal reinforcing structure around said panel and adhered to said film coating.

3 Claims, 3 Drawing Figures

IMPLOSION PROTECTED CRT

BACKGROUND OF THE INVENTION

This invention relates to a CRT (cathode-ray tube) having an improved implosion-protection system.

One form of CRT comprises an evacuated envelope including a glass faceplate panel having a viewing window and a rearwardly-extending peripheral flange or sidewall. The extended end of the sidewall is sealed to the large opening of a glass funnel. Atmospheric pressure pressing against the external surface of the window may exert forces totaling several tons against the window. Should the window shatter (implode), these forces drive fragments into the tube, which fragments may bounce back through the shattered window and may cause injury to persons nearby. Also, when the window shatters, fragments of the funnel may also be driven through the shattered window. In this art, the amount of glass in fragments that are driven or thrown toward the viewer is called the throw of glass. To add strength and stability to the structure, most CRT windows are arched or domed, which has the effect of reducing the amount of glass fragments that are driven by the implosion.

It has been proposed to render a CRT more resistant to implosion and to reduce the throw of glass during the implosion by encircling the sidewalls of the panel with a metal and/or plastic reinforcing structure, which will hold the sidewall in place should fracture occur, until the tube is substantially devacuated. In some forms, the reinforcing structure is attached to the tube with an adhesive, and may or may not include a tensioned metal band encircling the sidewalls.

More recently, it has been proposed to use a coating of polyurethane on external portions of the envelope. Such a coating has been proposed for use by itself alone or in nonoverlapping relationship with metal reinforcing structures.

There are some CRT types in which the window of the tube is substantially flat where the prior reinforcing structures have not proved to be adequate. In such flat-faced tubes, described, for example, in U.S. Pat. No. 3,416,026 to I. Niwa and No. 3,837,829 to P. Lebel, there are far less strength and far less stability in the window, with the result that a much smaller blow causes the window to shatter and, also, when shattering occurs, the entire window fragments in the implosion. It is not possible to prevent the shattering of a substantially flat CRT window or to reduce the amount of driven glass with an implosion-protection system. However, the throw of glass can be reduced by the novel combination so that the CRT is safe to use.

SUMMARY

The novel combination comprises a CRT comprising an envelope including a glass faceplate panel sealed to an adjoining glass funnel. An elastomeric film coating consisting essentially of polyurethane is adhered to the outer surfaces completely around the panel, and a continuous metal reinforcing structure is adhered to the film coating completely around the panel.

The polyurethane film coating has unusual tensile strength and unusual adherence to glass whereby fractured fragments of the panel to which the coating is adhered may move but are kept together during and after an implosion. Also, most of the adhesives previously used with the metal reinforcing structure are more adherent to the polyurethane film coating than to the glass surfaces of the panel, thereby providing additional strength to keep the coated fragments together.

The funnel may also include integral means, such as abraded or ridged surfaces, which facilitate the fracture of the funnel and permit window fragments that are driven by an implosion to pass through the fragmented funnel into the cabinet in which the tube is installed.

DESCRIPTION OF THE PREFERRED EMBODIMENTS

Figure 1:
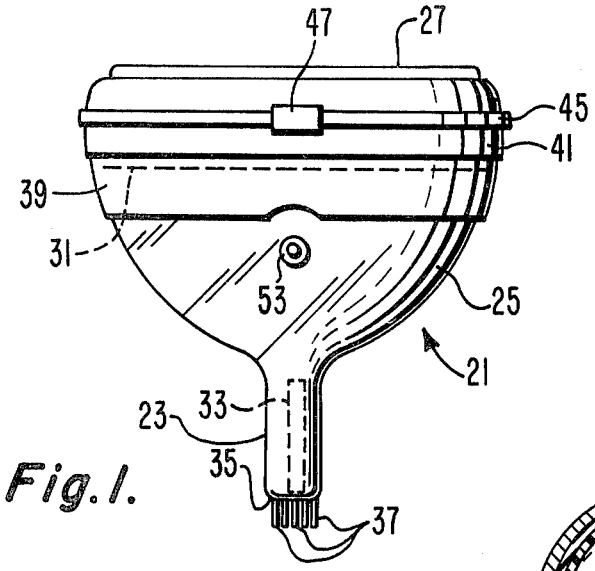
FIG. 1 is an elevational view of a CRT having a preferred implosion-protection structure according to the invention.
Figure 2:
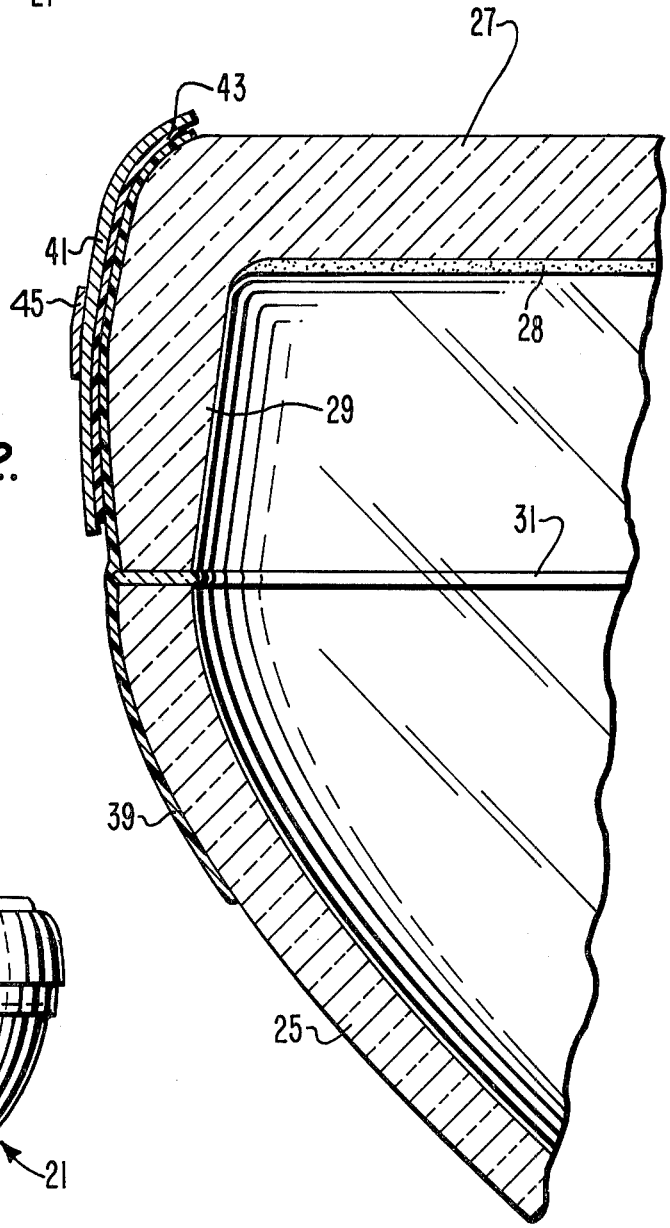
FIG. 2 is a sectional fragmentary view of the CRT shown in FIG. 1.

The cathode-ray tube illustrated in FIG. 1 and FIG. 2 includes an evacuated envelope designated generally by the numeral 21. The envelope 21 includes a glass neck 23 integral with a funnel 25 and a rectangular faceplate panel comprising a viewing window 27 having a peripheral integral sidewall 29. The window is substantially flat having a rise of only about 0.25 mm from center to the diagonal corners of the window for about a 620 mm screen diagonal. The extended end of the sidewall 29 is sealed to the wide end of the funnel 25 by a seal 31, such as devitrified glass. A luminescent screen 28 resides on the inside surface of the viewing window 27. The luminescent screen, when suitably scanned by an electron beam from a gun 33 housed in the neck 23, is capable of producing a luminescent image which may be viewed through the viewing window 27.

The neck 23 is closed and sealed by a stem 35 having stem leads 37 extending therethrough. A continuous peripheral film coating 39 of polyurethane about 0.127 mm (5 mils) thick is adhered to external surface portions of the sidewall 29 and the funnel 25 on each side of the seal 31. The film coating 39 is about 12.5 cm (5 inches) wide, extending from the seal 31 about 5 cm toward the window 27 and 7.5 cm toward the neck 23. A continuous metal reinforcing structure is located around the panel and is adhered to the polyurethane coating 39 in overlapping relationship therewith. In the embodiment shown in FIGS. 1 and 2, a reinforcing structure comprises two U-shaped rim plates 41 so positioned as to encircle the sidewalls 29. The rim plates are adhered to the film coating 39 with a cured epoxy or polyester adhesive 43. Also, a metal band 45 is tensioned around the rim plates 41 and fastened by crimping with a metal clip 47. Similar reinforcing structures are described in U.S. Pat. No. 3,220,593 to D. E. Powell, et al.

The interior of the envelope is evacuated to a high level of vacuum (low pressure) of the order of $10^{-5}$ mm Hg. In this example, with a 19 V 90° rectangular color tube, atmospheric pressure pressing against the external surface of the viewing window exerts forces totaling about 1800 kilograms (4000 lbs.). Circumferential tensile stresses as high as 70 kg/cm$^2$ (1000 lbs./in.$^2$) are present in the sidewall 29 and the adjacent portions of the funnel 25. Should the viewing window fracture, atmospheric pressure would ordinarily drive window fragments inward against the funnel portion 25 and then bounce outward. This implosion-protection system does not prevent an implosion but, instead, reduces the chance of injury to viewers near the tube face. Particularly, this implosion-protection system reduces the distance that the glass fragments are thrown. In the novel tubes, should the window 27 fracture, the film coating 39 which is adherent to external envelope surfaces maintains the adjacent glass in place while permitting gas to rush into the tube, reducing the pressure differential on opposite sides of the window 27, thereby reducing the forces which drive glass fragments into flight. To determine the adequacy of implosion protection of tubes described herein, implosion tests specified in publication UL 1418 by Underwriters Laboratories, Inc., Chicago, Ill., were used.

The film coating 39 for the novel tube of FIG. 1 is fabricated on the tube after the envelope 21 is completely evacuated of gases and sealed, and the electrodes of the gun 33 have been electrically processed. In a preferred method of fabrication, a quantity of an emulsion of polyurethane in a water base is diluted with water to the desired viscosity. One suitable polyurethane emulsion is RS 5302 marketed by PPG Industries, Coating and Resin Products Division, Pittsburgh, Pa.

The mixture is then brushed, flowed or sprayed on the desired areas using a stencil to mask off these areas. When spraying on the emulsion, which is preferred, it has been found to be convenient to monitor the emulsion-coating thickness by including a water-soluble dye, such as Blue HIdrocol Alpha, marketed by Hercules Inc., Glen Falls, N.Y., in the emulsion and then applying the emulsion to a depth of a color corresponding to the desired thickness. After the emulsion has been applied, the emulsion coating is dried and the solids therein coalesced to a film whereby the coating is cured. This may be done by placing the tube in an oven at about 20° to 120° C. for 30 to 5 minutes, preferably about 90° C. for about 10 minutes. Alternatively, or in addition, the tube may be preheated in an oven to about 20° to 90° C., preferably about 50° C., prior to applying the emulsion coating. After the coating has been cured, the film is at least 0.075 mm (3 mils) thick and preferably about 0.125 mm (5 mils) thick. Greater thicknesses are not detrimental to implosion protection, although too thick a film results in excessive material costs. It is surprising that improved protection can be realized with such thin films and with the use of so little polymeric material.

Figure 3:
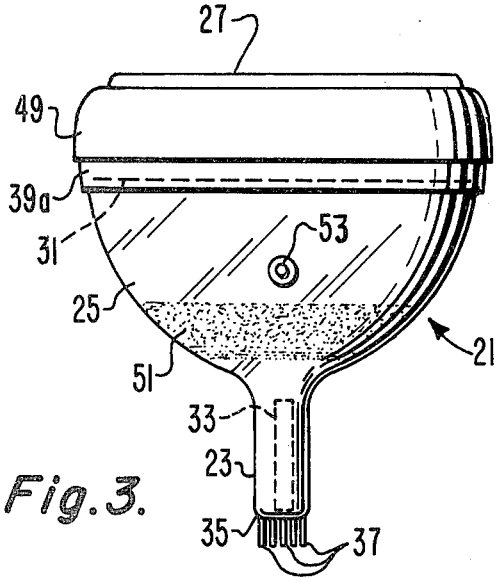
FIG. 3 is an elevational view of a CRT having another implosion-protection system according to the invention.

FIG. 3 is identical in structure to that of FIG. 1 except for the extent of the film coating 39 and the design of the reinforcing structure. Hence, similar reference numerals are used for similar structures. In FIG. 3, a film coating 39*a* extends back on the funnel 25 just beyond the seal 31. Also, in FIG. 3, the metal reinforcing structure comprises a continuous metal shell 49 around the panel sidewall. The shell 49 is adhered to the film coating 39*a* with a cured epoxy or polyester adhesive.

One additional feature is shown in FIG. 3. Upon shattering, the window fragments move into the CRT and into the cabinet (not shown) in which the CRT is mounted. Since the funnel 25 is relatively strong because of its shape and thickness, the window fragments usually bounce back and out of the CRT. However, in this embodiment, the funnel 25 is made weaker so that it will fracture upon impact from the driven window fragments, and the funnel fragments will be driven into the cabinet, where they will come to rest. As shown in FIG. 3, an outer surface area 51 of the funnel 25 between the anode button 53 and the neck 23 is abraded. Instead of abrading an area 51 of the funnel surface, a waffle pattern or other pattern of grooves can be molded or abraded into the surface area. Also, the abraded area or grooved area can be on the inner surface of the funnel 25 or on both the inner and outer surfaces of the funnel 25.

I claim:

1. In combination, a cathode-ray tube comprising an envelope including a glass faceplate panel and an adjoining glass funnel sealed to said panel, an elastomeric film coating consisting essentially of polyurethane around and adhered to said panel, and a continuous metal reinforcing structure around said panel and adhered to said film coating in overlapping relationship therewith, said funnel including integral means therein for facilitating the fracturing thereof when window fragments from an implosion of said tube strike said funnel.

2. The combination defined in claim 1 wherein extended surfaces of said glass funnel are abraded to facilitate the fracture thereof.

3. The combination defined in claim 1 wherein surfaces of said funnel include a pattern of valleys and ridges molded therein to facilitate the fracture thereof.

* * * * *